US009856790B2

(12) United States Patent
Choi

(10) Patent No.: US 9,856,790 B2
(45) Date of Patent: Jan. 2, 2018

(54) VARIABLE COMPRESSION RATIO APPARATUS

(71) Applicant: Hyundai Motor Company, Seoul (KR)

(72) Inventor: Myung Sik Choi, Seoul (KR)

(73) Assignee: Hyundai Motor Company, Seoul (KR)

( * ) Notice: Subject to any disclaimer, the term of this patent is extended or adjusted under 35 U.S.C. 154(b) by 65 days.

(21) Appl. No.: 14/956,327

(22) Filed: Dec. 1, 2015

(65) Prior Publication Data

US 2017/0044976 A1 Feb. 16, 2017

(30) Foreign Application Priority Data

Aug. 10, 2015 (KR) ..... 10-2015-0112387

(51) Int. Cl.
*F02B 75/04* (2006.01)
*F02D 15/02* (2006.01)

(52) U.S. Cl.
CPC ..... *F02B 75/044* (2013.01); *F02D 15/02* (2013.01)

(58) Field of Classification Search
CPC ..... F02B 75/04; F02B 75/044; F02D 15/00; F02D 15/02; F16J 1/09
USPC ..... 123/48 A, 78 A, 48 R, 78 R
See application file for complete search history.

(56) References Cited

U.S. PATENT DOCUMENTS 4,079,707 A * 3/1978 Karaba ..... F02B 75/044 123/48 B
5,178,103 A * 1/1993 Simko ..... F02D 15/02 123/48 B
5,257,600 A 11/1993 Schechter et al.
6,966,282 B2 * 11/2005 Hirano ..... F02B 75/044 123/48 B
8,151,691 B2 * 4/2012 Pirault ..... F02B 75/044 123/78 R
2004/0231619 A1 * 11/2004 Hirano ..... F02D 15/02 123/48 B
2012/0227705 A1 * 9/2012 Ashizawa ..... F02B 75/044 123/435

FOREIGN PATENT DOCUMENTS

JP 57-57237 U 4/1982
JP 63-97836 A 4/1988
JP 2002-155769 A 5/2002
JP 2007-247527 A 9/2007
KR 1999-005205 A 1/1999

* cited by examiner

*Primary Examiner* — Grant Moubry
(74) *Attorney, Agent, or Firm* — Morgan, Lewis & Bockius LLP

(57) ABSTRACT

A variable compression ratio apparatus may include a plunger configured to move up and down in response to rotation of a crank shaft, a piston having a chamber formed thereinside, into which the plunger is inserted, and configured to move up and down with the plunger, the chamber including an upper chamber formed above the plunger and a lower chamber formed below the plunger, a spool valve configured to selectively supply oil to the upper chamber or to the lower chamber, and a controller configured to control the spool valve so that the piston moves up and down with respect to the plunger.

6 Claims, 3 Drawing Sheets

VARIABLE COMPRESSION RATIO APPARATUS

CROSS-REFERENCE TO RELATED APPLICATION

The present application claims the priority to Korean Patent Application No. 10-2015-0112387, filed on Aug. 10, 2015, the entire contents of which is incorporated herein for all purposes by this reference.

BACKGROUND OF THE INVENTION

Field of the Invention

The present invention relates to a variable compression ratio apparatus, and more particularly to a variable compression ratio apparatus for controlling variation of an engine compression ratio.

Description of Related Art

In general, the thermal efficiency of combustion engines is increased when the compression ratio is high. In the case of a spark ignition engine, the thermal efficiency thereof is increased when ignition timing is advanced to a certain level. However, when the ignition timing of a spark ignition engine is advanced at a high compression ratio, abnormal combustion may occur, thereby damaging the engine. Therefore, there is a limitation on the amount that the ignition timing can be advanced, and the corresponding degradation of output should be tolerated.

A variable compression ratio (VCR) apparatus serves to change the compression ratio of the gas mixture depending on the operational state of an engine. The variable compression ratio apparatus improves fuel efficiency by increasing the compression ratio of the gas mixture when the load on the engine is low. Further, the variable compression ratio apparatus prevents the occurrence of knocking and improves engine output by reducing the compression ratio of the gas mixture when the load on the engine is high.

A conventional variable compression ratio apparatus changes the compression ratio by changing the length of a connecting rod, which connects a piston and a crank shaft. However, because the connection structure between the piston and the crank shaft includes several links, the structure of the variable compression ratio apparatus becomes complicated, inertial mass is increased, and the volume of the package is increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable compression ratio apparatus which can control variation of an engine compression ratio by adjusting the height of a piston through hydraulic pressure without using a link mechanism.

In accordance with the present invention, the above and other objects can be accomplished by the provision of a variable compression ratio apparatus including a plunger configured to move up and down in response to rotation of a crank shaft, a piston having a chamber formed thereinside, into which the plunger is inserted, and configured to move up and down with the plunger, the chamber including an upper chamber formed above the plunger and a lower chamber formed below the plunger, a spool valve configured to selectively supply oil to the upper chamber or to the lower chamber, and a control unit configured to control the spool valve so that the piston moves up and down with respect to the plunger.

The spool valve may include a first port connected with the upper chamber through a first oil line, a second port connected with the lower chamber through a second oil line, and a supply port connected with an oil pump.

The control unit may control the spool valve so that the supply port communicates with the first port, in order to move the piston upwards.

The control unit may control the spool valve so that the supply port communicates with the second port, in order to move the piston downwards.

The plunger may include a plunger head inserted into the chamber so as to move up and down in the chamber, the plunger head having a width that is equal to a width of the chamber and a height that is lower than a height of the chamber.

The chamber may have collision-preventing protrusions protruding inwards along peripheries of a top and a bottom of the chamber, and the plunger head may have collision-preventing recesses formed along peripheries of a top and a bottom of the plunger head and having a shape corresponding to a shape of the collision-preventing protrusions.

The control unit may control the spool valve through an oil control valve.

The control unit may control the spool valve through a solenoid valve.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
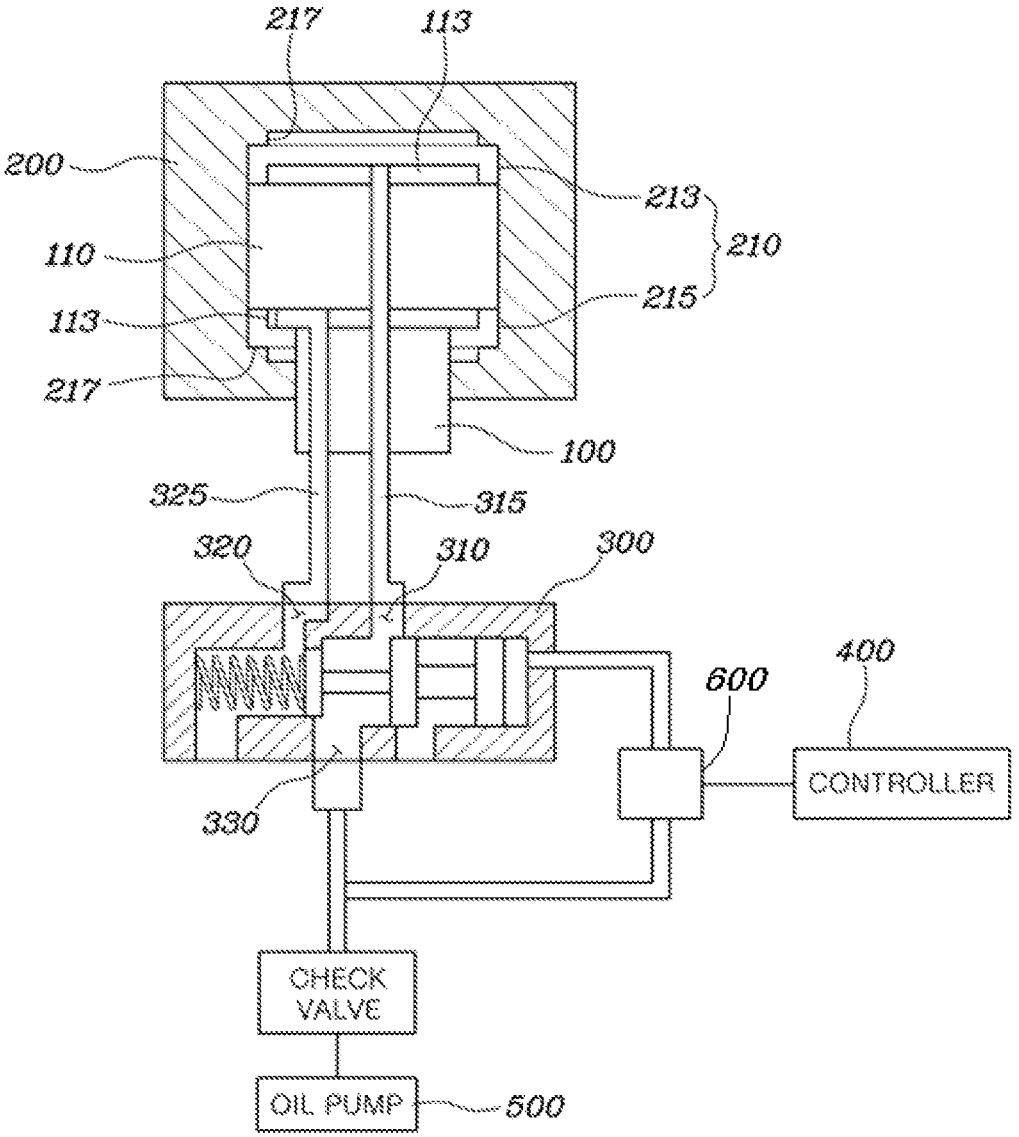
FIG. 1 is a view illustrating a variable compression ratio apparatus according to an embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EXEMPLARY EMBODIMENTS

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Reference will now be made in detail to the exemplary embodiments of the present invention, examples of which are illustrated in the accompanying drawings. Wherever possible, the same reference numbers will be used throughout the drawings to refer to the same or like parts.

FIG. 1 is a view illustrating a variable compression ratio apparatus according to an exemplary embodiment of the present invention. Referring to FIG. 1, a variable compression ratio apparatus includes a plunger 100 configured to move up and down in response to the rotation of a crank shaft, a piston 200 having a chamber 210 formed therein-side, into which the plunger 100 is inserted, and configured to move up and down with the plunger 100, a spool valve 300 configured to selectively supply oil to an upper chamber 213 of the chamber 210 or to a lower chamber 215 of the chamber 210, and a controller 400 configured to control the spool valve 300 so that the piston 200 can move up and down with respect to the plunger 100.

The plunger 100 has one end inserted into the piston 200 and the other end connected with a connecting rod, and thus moves up and down in response to the rotation of the crank shaft. The piston 200 undergoes a linear reciprocating motion in the cylinder by moving up and down with the plunger 100 inserted thereinto.

Further, since the plunger 100 is inserted into the chamber 210 formed inside the piston 200, the piston 200 can move up and down separately from the plunger 100 inserted into the chamber 210, thereby varying the height of the piston 200.

Described in detail, the plunger 100 includes a plunger head 110 inserted into the chamber 210. The upper chamber 213 is formed above the plunger head 110, and the lower chamber 215 is formed below the plunger head 110. If oil is supplied to the upper chamber 213 formed above the plunger head 110 through the spool valve 300, the piston moves upwards. Conversely, if oil is supplied to the lower chamber 215 formed below the plunger head 110 through the spool valve 300, the piston moves downwards. In this way, the controller 400 can vary the height of the piston 200 by controlling the operation of the spool valve 300.

As described above, if the piston 200 moves upwards, the height of the piston 200 is increased, and the engine compression ratio is increased. If the piston 200 moves downwards, the height of the piston 200 is decreased, and the engine compression ratio is decreased. As such, the engine compression ratio can be varied by adjusting the height of the piston 200 depending on the driving environment and conditions, thereby improving fuel efficiency and engine output.

The spool valve 300 may include a first port 310 connected with the upper chamber 213 through a first oil line 315, a second port 320 connected with the lower chamber 215 through a second oil line 325, and a supply port 330 connected with an oil pump 500.

The oil pump 500 is configured to supply oil from an oil pan to the chamber 210 through the spool valve 300. The oil can be selectively supplied to the upper chamber 213 or the lower chamber 215 by controlling the spool valve 300 so that the supply port 330 communicates with the first port 310 or the second port 320.

For instance, in order to move the piston 200 upwards, the controller 400 controls the spool valve 300 so that the supply port 330 communicates with the first port 310.

Figure 2:
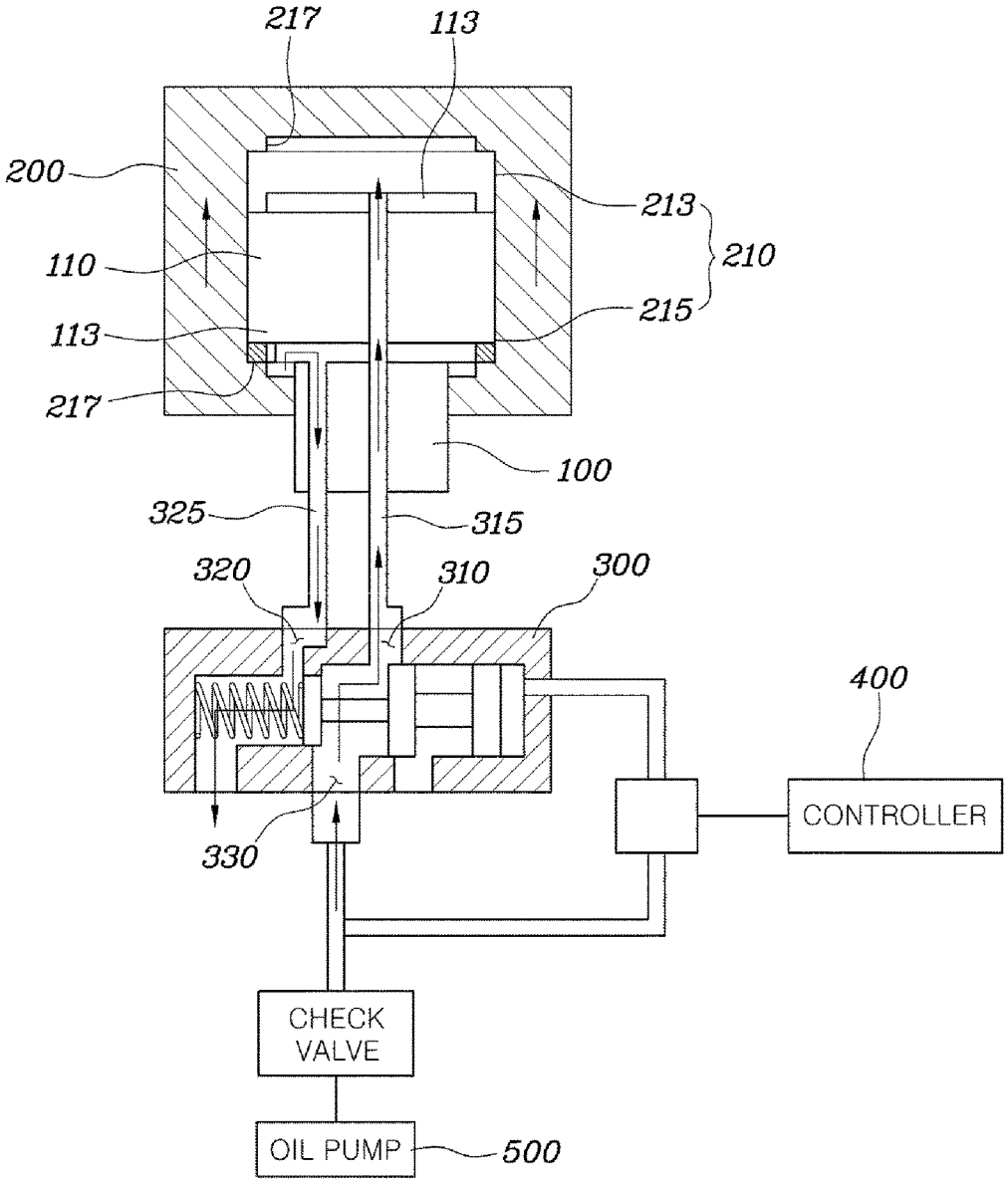
FIG. 2 is a view illustrating the operation of a spool valve when a piston is controlled to move upwards.

FIG. 2 is a view illustrating the operation of the spool valve when the piston is controlled to move upwards. If the spool valve 300 is controlled so that the supply port 330 and the first port 310 communicate with each other, oil is supplied to the upper chamber 213 by the oil pump 500, and the oil remaining in the lower chamber 215 is discharged to the oil pan through the second port 320. Accordingly, as the upper chamber 213 is filled with the oil, the piston 200 moves upwards with respect to the plunger 100, and thus the height of the piston 200 is increased.

Conversely, in order to move the piston 200 downwards, the controller 400 controls the spool valve 300 so that the supply port 330 communicates with the second port 320.

Figure 3:
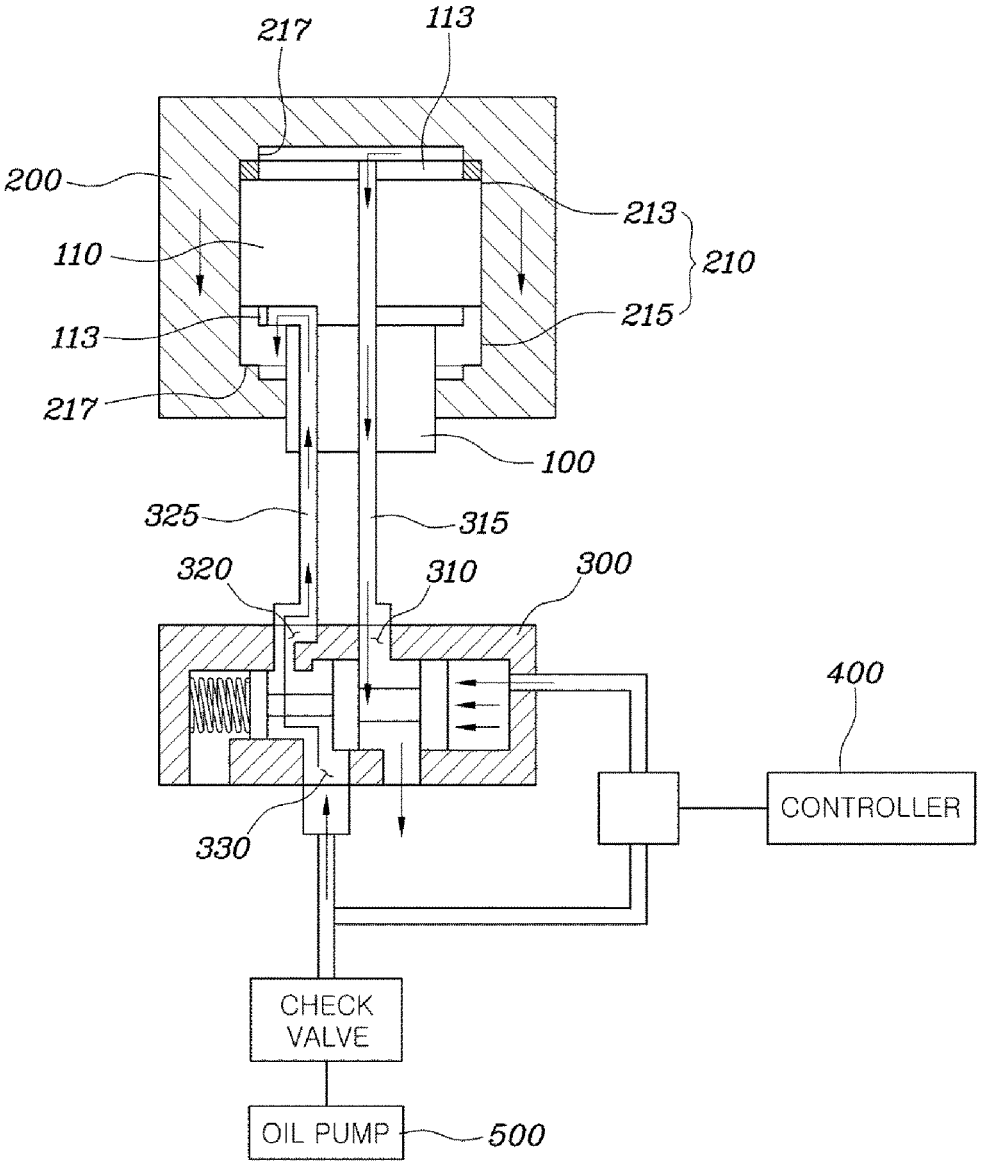
FIG. 3 is a view illustrating the operation of the spool valve when the piston is controlled to move downwards.

FIG. 3 is a view illustrating the operation of the spool valve when the piston is controlled to move downwards. If the spool valve 300 is controlled so that the supply port 330 and the second port 320 communicate with each other, oil is supplied to the lower chamber 215 by the oil pump 500, and the oil remaining in the upper chamber 213 is discharged to the oil pan through the first port 310. Accordingly, as the lower chamber 215 is filled with the oil, the piston 200 moves downwards with respect to the plunger 100, and thus the height of the piston 200 is decreased.

As such, the controller 400 controls the operation of the spool valve 300 so as to change the height of the piston 200, thereby varying the engine compression ratio.

As shown in FIGS. 2 and 3, the spool valve 300 includes two additional ports besides the first port 310, the second port 320 and the supply port 330. These additional ports serve to discharge the oil, which has been discharged from the chamber 210 through the first port 310 or the second port 320, to the oil pan.

The method of controlling the spool valve 300 is as follows. In one embodiment, the controller 400 may control the spool valve 300 through an oil control valve (OCV) 600. The OCV may be disposed between one end of the spool valve 300 and the oil pump 500. If the OCV is opened by the controller 400, oil is supplied to one end of the spool valve 300, and a spool is moved to the other end of the spool valve 300 by hydraulic pressure. Conversely, if the OCV is closed by the controller 400, the spool is moved back to the one end of the spool valve 300 by the restoring force of a spring. The opening/closing of the spool valve 300 can be controlled as described above.

In another embodiment, the controller 400 may control the spool valve 300 through a solenoid valve. The solenoid valve may be disposed between one end of the spool valve 300 and the oil pump 500. If the solenoid valve receives an electric signal from the controller 400, the valve is opened to supply oil to one end of the spool valve 300, and the spool is moved to the other end of the spool valve 300. Conversely, if the controller 400 does not transmit an electric signal, the supply of oil to the one end of the spool valve 300 is stopped, and the spool is moved back to the one end of the spool valve 300 by the restoring force of a spring.

The plunger 100 includes a plunger head 110 that is inserted into the chamber 210 so as to move up and down in the chamber 210. The plunger head 110 may have a width that is equal to the width of the chamber 210, and a height that is lower than the height of the chamber 210.

Because the width of the plunger head 110 is equal to that of the chamber 210, the piston 200 just moves up and down along the plunger head 110 without moving left and right, thereby preventing the piston 200 from slanting.

As described above, since the chamber 210 is divided into the upper chamber 213 and the lower chamber 215 by the plunger head 110, to which oil is selectively supplied, variation in the height of the piston 200 can be achieved.

The chamber 210 may have collision-preventing protrusions 217 that protrude inwards along the peripheries of the top and bottom of the chamber 210. The plunger head 110 may have collision-preventing recesses 113 that are formed along the peripheries of the top and bottom of the plunger head 110 and have a shape corresponding to the shape of the collision-preventing protrusions 217.

For instance, when the piston 200 is controlled to move downwards by the controller 400, there may be the risk of a collision between the top of the plunger head 110 and the top of the chamber 210. At this time, as the piston 200 moves downwards, a space is formed between the collision-preventing protrusion 217 at the top of the chamber 210 and the collision-preventing recess 113 at the top of the plunger head 110, in which oil is confined. The hatched portion in FIG. 3 represents the space in which oil is confined. The speed at which the piston 200 moves downwards is reduced by resistance generated when the oil is discharged from the space, thereby preventing a collision between the plunger head 110 and the chamber 210.

Conversely, when the piston 200 moves upwards, as indicated by the hatched portion in FIG. 2, a space is formed between the collision-preventing protrusion 217 at the bottom of the chamber 210 and the collision-preventing recess 113 at the bottom of the plunger head 110, in which oil is confined. The speed at which the piston 200 moves upwards is reduced by resistance generated when the oil is discharged from the space, thereby preventing a collision between the plunger head 110 and the chamber 210.

Therefore, increased noise and decreased durability attributable to the collision between the plunger 100 and the piston 200 can be prevented.

In addition, as shown in FIGS. 1 through 3, a check valve may be provided between the oil pump 500 and the spool valve 300 in order to prevent the oil from flowing back to the oil pump 500. Also, a valve, which is embodied as an OCV or a solenoid valve, may be provided between the check valve and one end of the spool valve, and may be controlled by the controller 400.

As is apparent from the above description, the variable compression ratio apparatus according to an exemplary embodiment of the present invention can control variation of the engine compression ratio by adjusting the height of the piston without using a link mechanism, thereby minimizing the increase in the volume and weight of the package.

Further, the fuel efficiency, output and torque of an engine can be improved by variation of the engine compression ratio.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus comprising:

a plunger configured to move up and down in response to rotation of a crank shaft;

a piston having a chamber formed thereinside, into which the plunger is inserted, and configured to move up and down with the plunger, the chamber including an upper chamber formed above the plunger and a lower chamber formed below the plunger;

a spool valve configured to selectively supply oil to the upper chamber or to the lower chamber; and a controller configured to control the spool valve so that the piston moves up and down with respect to the plunger, wherein the plunger includes a plunger head inserted into the chamber to move up and down in the chamber, wherein the chamber includes: collision-preventing protrusions protruding inwards along peripheries of a top and a bottom of the chamber, and wherein the plunger head includes collision-preventing recesses formed along peripheries of a top and a bottom of the plunger head and having a shape corresponding to a shape of the collision-preventing protrusions.

2. The variable compression ratio apparatus according to claim 1, wherein the spool valve includes:

a first port connected with the upper chamber through a first oil line;

a second port connected with the lower chamber through a second oil line; and a supply port connected with an oil pump.

3. The variable compression ratio apparatus according to claim 2, wherein the controller controls the spool valve so that the supply port communicates with the first port, to move the piston upwards.

4. The variable compression ratio apparatus according to claim 2, wherein the controller controls the spool valve so that the supply port communicates with the second port, to move the piston downwards.

5. The variable compression ratio apparatus according to claim 1, the plunger head has a width that is equal to a width of the chamber and a height that is lower than a height of the chamber.

6. The variable compression ratio apparatus according to claim 1, wherein the controller controls the spool valve through an oil control valve.

* * * * *